United States Patent [19]

Dohren

[11] 4,088,439

[45] May 9, 1978

[54] TANGENTIALLY GAS FIRED MUFFLE

[75] Inventor: David George Dohren, Tarleton, England

[73] Assignee: Cooperheat, Southport, England

[21] Appl. No.: 731,951

[22] Filed: Oct. 13, 1976

[30] Foreign Application Priority Data

Sep. 14, 1976 United Kingdom ..... 38006/76

[51] Int. Cl.[2] ..... F24J 3/00; F27B 13/00

[52] U.S. Cl. ..... 432/225; 432/36; 432/185

[58] Field of Search ..... 432/225, 226, 184, 185, 432/36; 431/326

[56] References Cited

U.S. PATENT DOCUMENTS

| | | | |
|---|---|---|---|
| 1,575,087 | 3/1926 | Bardeen | 432/184 |
| 3,466,020 | 9/1969 | Blinne | 432/225 |
| 3,542,349 | 11/1970 | Ando et al. | 432/185 |
| 3,829,284 | 8/1974 | Hemingway et al. | 432/225 |
| 3,833,338 | 9/1974 | Badrock | 432/225 |
| 3,940,244 | 2/1976 | Sauder et al. | 432/247 |

*Primary Examiner*—John J. Camby
*Attorney, Agent, or Firm*—J. Rodman Steele, Jr.

[57] ABSTRACT

A tangentially gas fired muffle comprises a hinged annular housing defining inner and outer annular chambers divided by a ring of heat resistant perforate or expanded material. The outer annular chamber has inlets in the form of immersion tubes each locating an atmospheric burner, and outlet ports for discharging the products of the previous burner or burners. The perforate or expanded metal ring contains the combustion process in the outer annular chamber and also acts as a radiant for dissipating heat on a circumferential weld of two pipe sections. The gas burners are connected to a control console for supplying the burners continuously with gas at respective high and low flow rates. Solenoid valves, connected to temperature controllers, provide the burners continuously with gas at respective high and low flow rates. Energy regulators control the rate of heating. A self-holding relay and a gas pressure responsive switch provide a safety feature for isolating the electrical and gas supplies in the event of a supply failure.

11 Claims, 9 Drawing Figures

Figure 1:
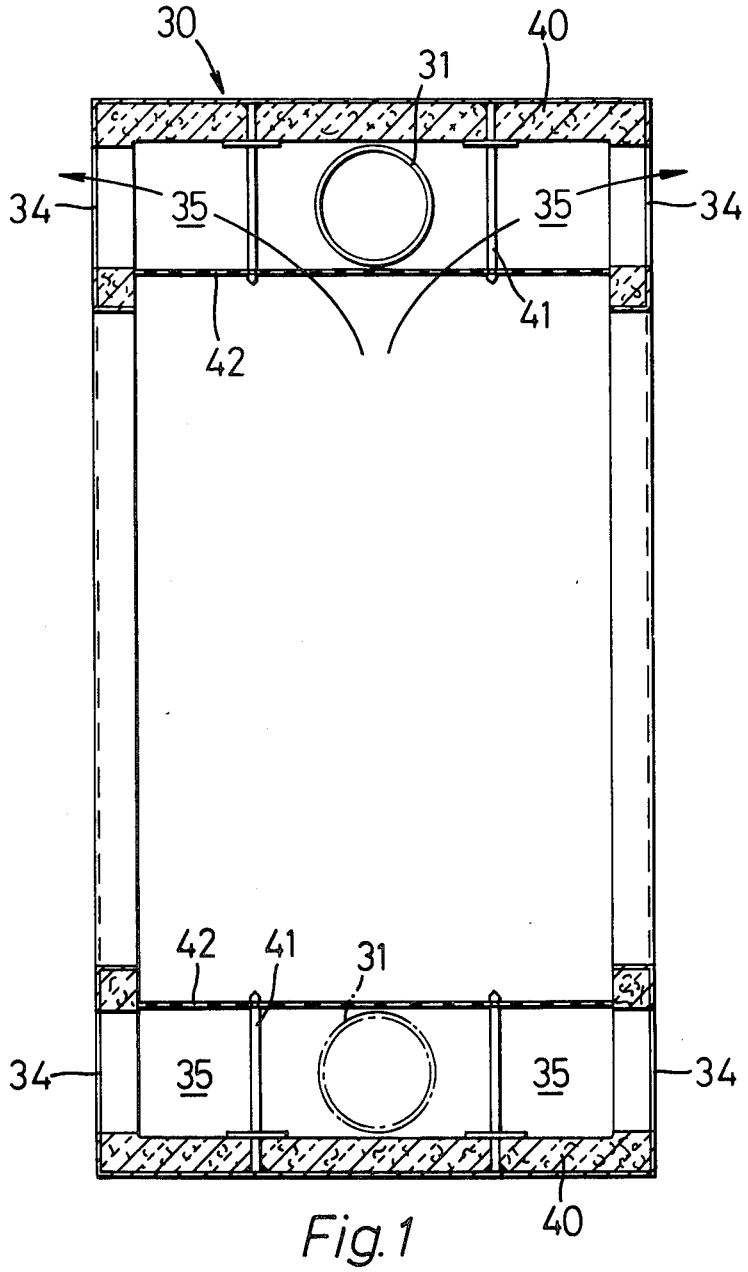

Fig. 4
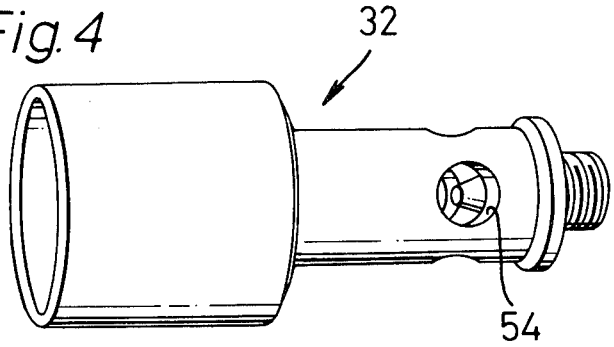
Fig. 5
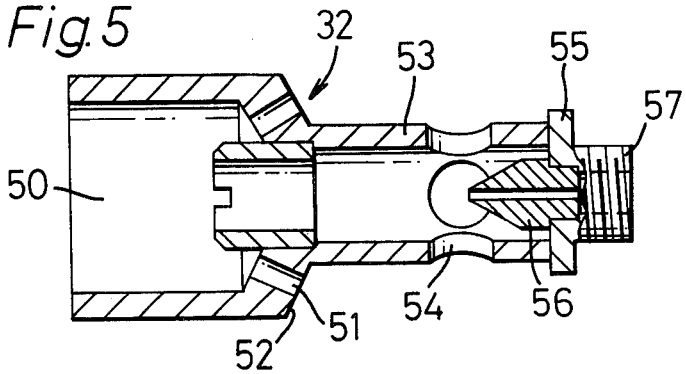
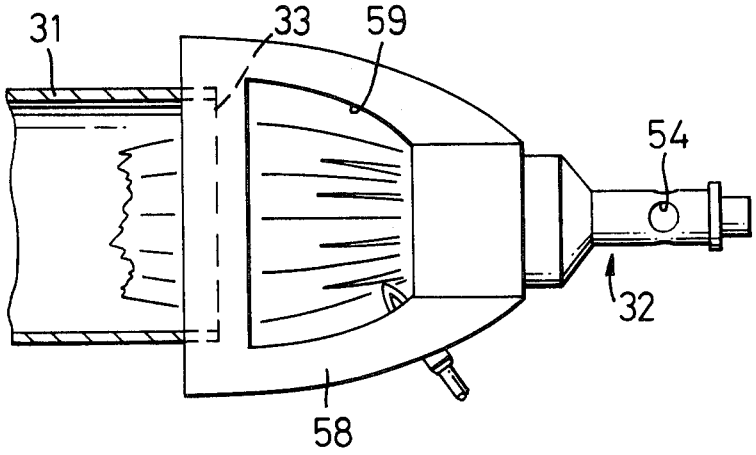
Fig. 6

TANGENTIALLY GAS FIRED MUFFLE

FIELD OF INVENTION

This invention relates to a tangentially gas fired muffle for heating pipes. It may be used, for example, as a means of post-heat treating pipe butt welds where the number of seans of one specific size warrants a tailor-made unit.

DESCRIPTION OF PRIOR ART

U.K. patent specification No. 1431753, corresponding to U.S. Pat. No. 3,829,284—Hemingway et al., describes apparatus for heat treating a circumferentially welded joint between two cylindrical pipe sections. The apparatus includes a continuous tubular casing having a U-shaped cross section which is divided by a ring, having a series of single apertures or perforations, into an outer annular chamber and an inner annular channel. The pipes are inserted through the central aperture of the annular casing so that the welded joint forms a circumferential base to the inner annular channel. The outer annular chamber has inlet ports for receiving hot gases injected at a high velocity. The inner annular channel has outlet ports acting as flues for the high velocity hot gases. The series of single apertures or perforations in the ring are provided to enable the high velocity hot gases in the outer annular chamber, which acts as a first distribution duct, to percolate through to the inner annular channel, which acts as a second distribution duct. The high velocity hot gas stream exits through the outlet ports in the inner annular channel after scrubbing the circumferential weld of the pipe sections.

The hot gases must be injected at a high velocity to overcome the fluidic impedances of the outer annular chamber, the series of single perforations or apertures and the inner annular channel. Therefore, a blower or compressor is required to force air through a pipe connected, for example, to a gas inlet pipe for supplying forced air gas burners.

Besides the disadvantage of requiring a blower or compressor, which adds to the bulk and expense of the apparatus, the prior art method relied only on the circulation of hot gases to heat the welded pipes. As the prior art method relied only on the thermal exchange between the heated gas stream circulating the inner annular channel and the walls of the pipe sections, some of the heat was wasted. Moreover, as the flow of these gases was considerably impeded by the single row of apertures or perforations in the ring separating the outer annular chamber and the inner annular channel, the prior art method did not envisage the use of atmospheric burners. Atmospheric burners produce hot gases at a much lower velocity and are normally susceptible to lighting back or burning back if the fluidic impedence, connected to receive the products of combustion, is too high.

A further disadvantage of the prior art arrangement was that either the annular casing had to be introduced over the welded pipes, since it was continuous, or the pipes had to be introduced through the aperture in the annular casing. This can be a time consuming process and also lead to difficulties in handling large welded pipes.

SUMMARY OF INVENTION

The present invention overcomes the problems and disadvantages noted above in the prior art by providing a tangentially gas fired muffle fitted with atmospheric burners, thereby avoiding the need for a blower or compressor, the muffle being split and hinged for ease of assembly on a welded pipe joint. The muffle comprises an annular housing defining an outer annular chamber provided with tangential inlet ports in the form of immersion tubes, each immersion tube locating a respective atmospheric gas burner. The outer annular chamber is also provided with outlet ports which are arranged to discharge the products of combustion of the preceding gas burner or burners. The annular housing also contains a ring of perforate or expanded material, such as expanded Inconel, which defines the inner annular wall of the first annular chamber and the outer annular wall of a second annular chamber. The second chamber is positioned, in use, adjacent the walls of the welded pipe sections, so that the perforate or expanded metal ring is adjacent the circumferential pipe weld. In this case, the products of combustion of the burners do not have to pass through the perforate or expanded metal ring enroute to the outlet ports, because both the inlet and the outlet ports are provided in the outer annular chamber. This reduces the fluidic impedence of the arrangement thereby enabling the use of atmospheric gas burners. The ring acts as both a radiant to dissipate heat uniformly onto the pipe surfaces and also prevents flame impingement onto the pipe surface by containing the combustion process in the first annular chamber. The use of gas burners has been avoided in the prior art, due to the problems of hot spots created by flame impingement. However, the present invention overcomes this problem and now makes possible the use of atmospheric burners which were previously thought to be unsuitable in this field.

At least two gas burners are provided across a diameter of the annular housing, but more burners are used, which are equidistantly spaced about the periphery of the annular housing, in accordance with the diameter of the pipe sections to be heat treated. The disposition of these burners and the pressure of the gas supply is selected in accordance with the sizes of the pipe sections and muffle to be used.

In a preferred embodiment of the invention, said outlet ports are located in the side walls of the annular housing adjacent the inlet ports or immersion tubes. The products of combustion can thereby circulate the outer annular chamber so that the products from the previous burner or burners are discharged through the outlet ports adjacent the next burner. The annular housing is split, hinged and fitted with means for securing the split parts together whereby the housing may be hinged open to accommodate the pipe sections and the hinged part subsequently closed together and fastened by securing means. Thus, the muffle need not be fitted over the pipe sections and the pipe sections need not be introduced through a central aperture as in the prior art.

The ring is preferably made from expanded metal, such as Inconel in the form of "Exapamet" (Registered Trade Mark). As mentioned above, it acts as a radiant and confines the combustion process in the outer annular chamber and it also allows some of the hot combustion products to percolate through onto the welded joint of the pipe sections. The outer annular chamber is preferably lined with insulation in the form of a ceramic fibre blanket such as "Kerlane 45" which is commercially available. The blanket may be impaled on heat resistant pins which are circumferentially spaced about the outer annular chamber and which support the perforate or expanded metal ring.

The gas burners may be connected to a control console including first solenoid valve means for supplying gas at a high flow rate to said burners and second solenoid valve means for supplying gas at a low flow rate to said burners. Temperature controlling means, for example, fitted with thermocouples to sense the temperature within the muffle, are connected to the first solenoid valve means whereby the burners are supplied with gas continuously at respective high and low flow rates. The rate of heating may be controlled by energy regulating means connected to the temperature controlling means. A safety feature is provided by a self-holding relay means for isolating the electrical circuit in the event of a power failure, and the gas pressure responsive switching means for isolating the gas burners in the event of a reduction in gas pressure below a predetermined value.

Therefore, the main object of the invention is to provide a tangentially gas fired muffle which employs atmospheric burners thereby avoiding the need for compressors or blowers.

Figure 2:
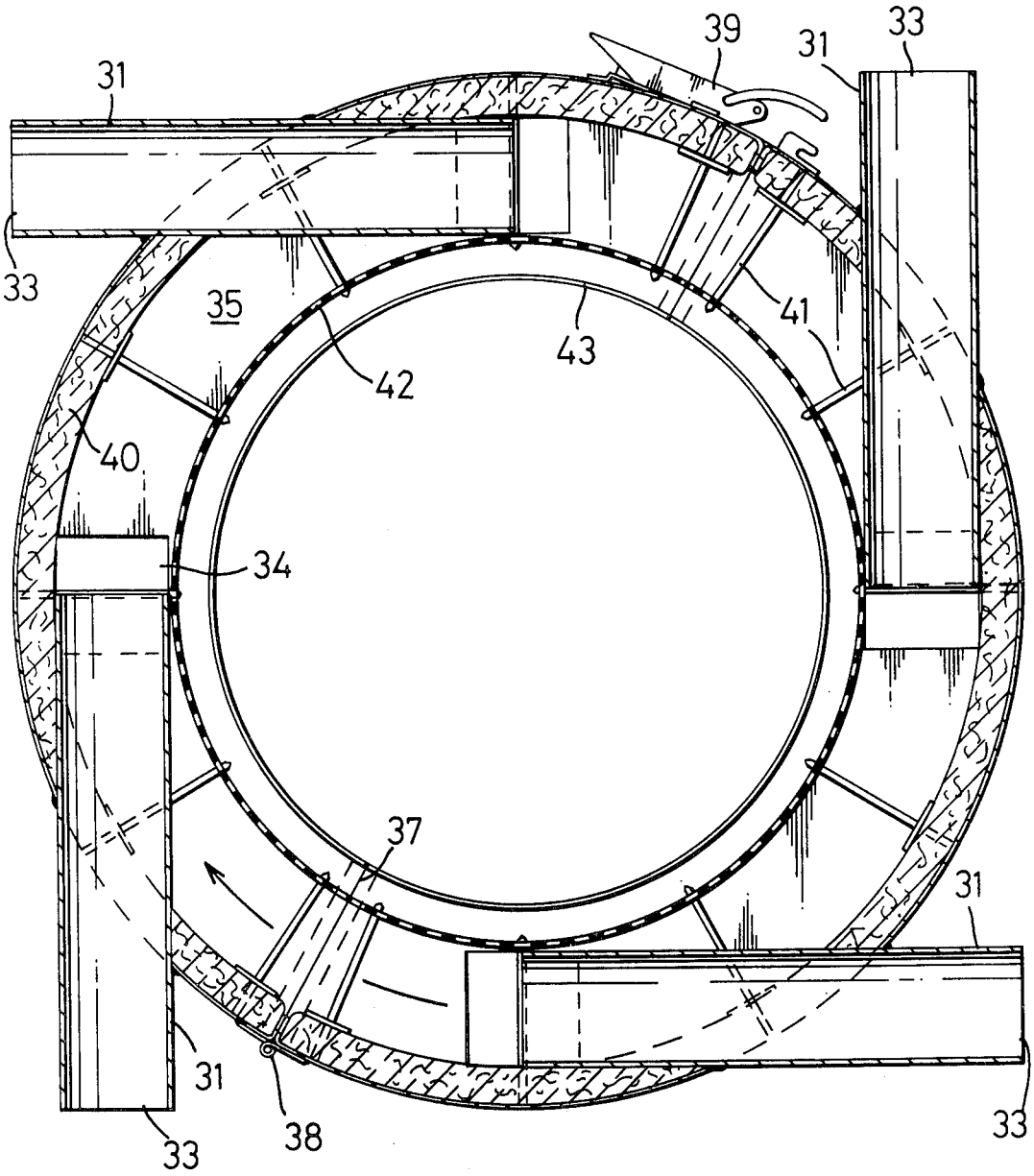
Figure 3:
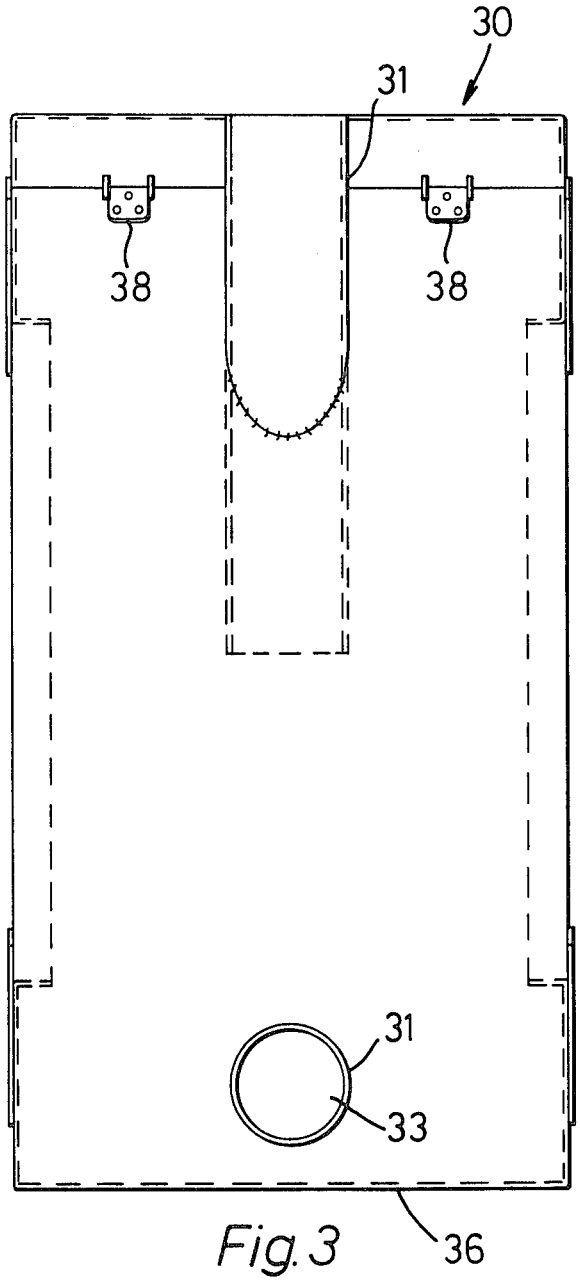
Figure 7:
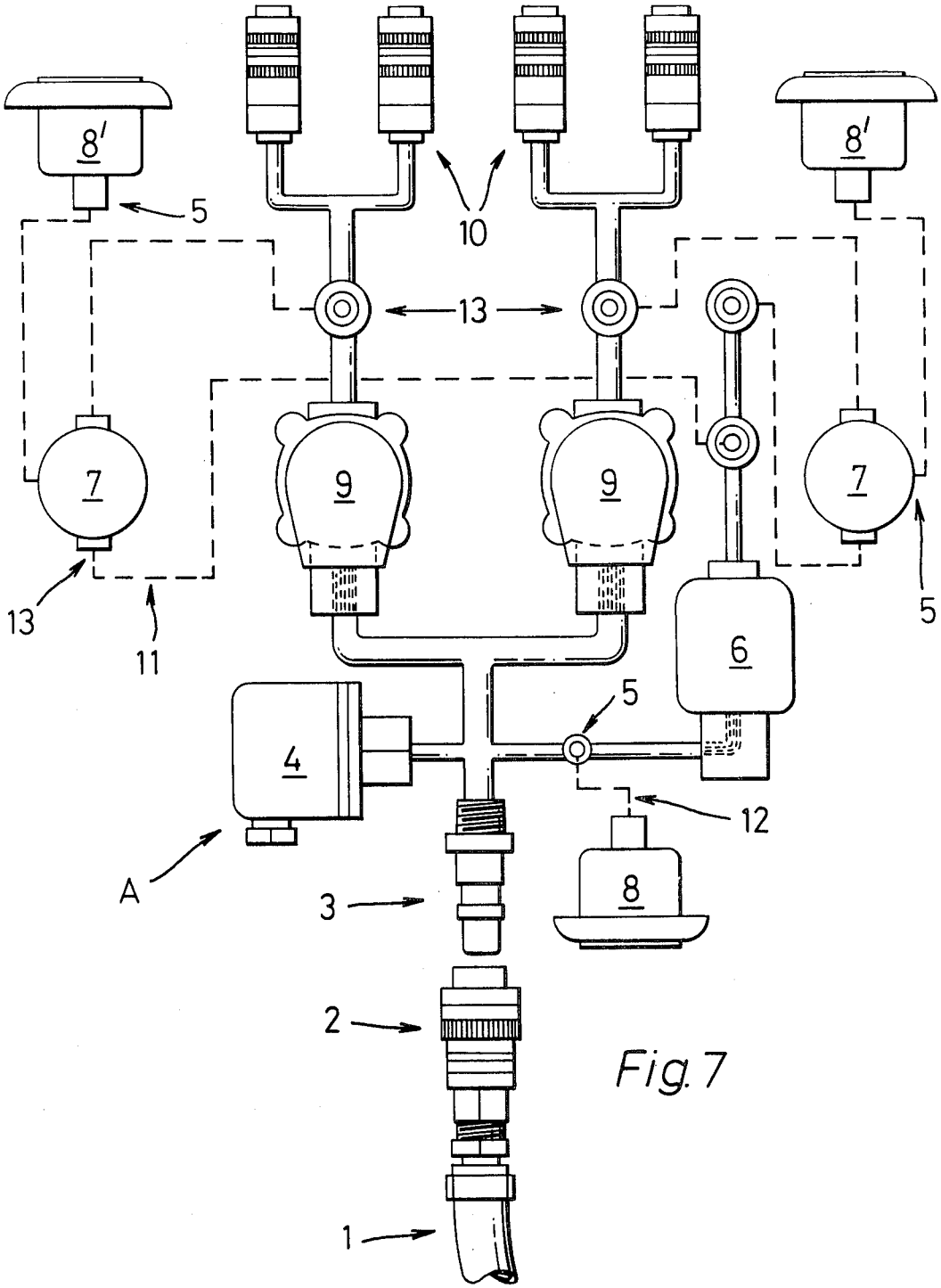

Other objects and advantages of the invention will become apparent from the following description, taken in conjunction with the accompanying drawings, in which:

FIGS. 1–3 respectively show sectional elevation, sectional plan and elevational views of a tangentially gas-fired muffle;

FIGS. 4 and 5 respectively show end-on, sectional end-on and perspective views of an aerated gas burner;

FIG. 6 schematically illustrates an aerated gas burner fitted to an immersion tube;

FIG. 7 schematically illustrates a gas supply circuit for four burners, and

Figures 8, 8A:
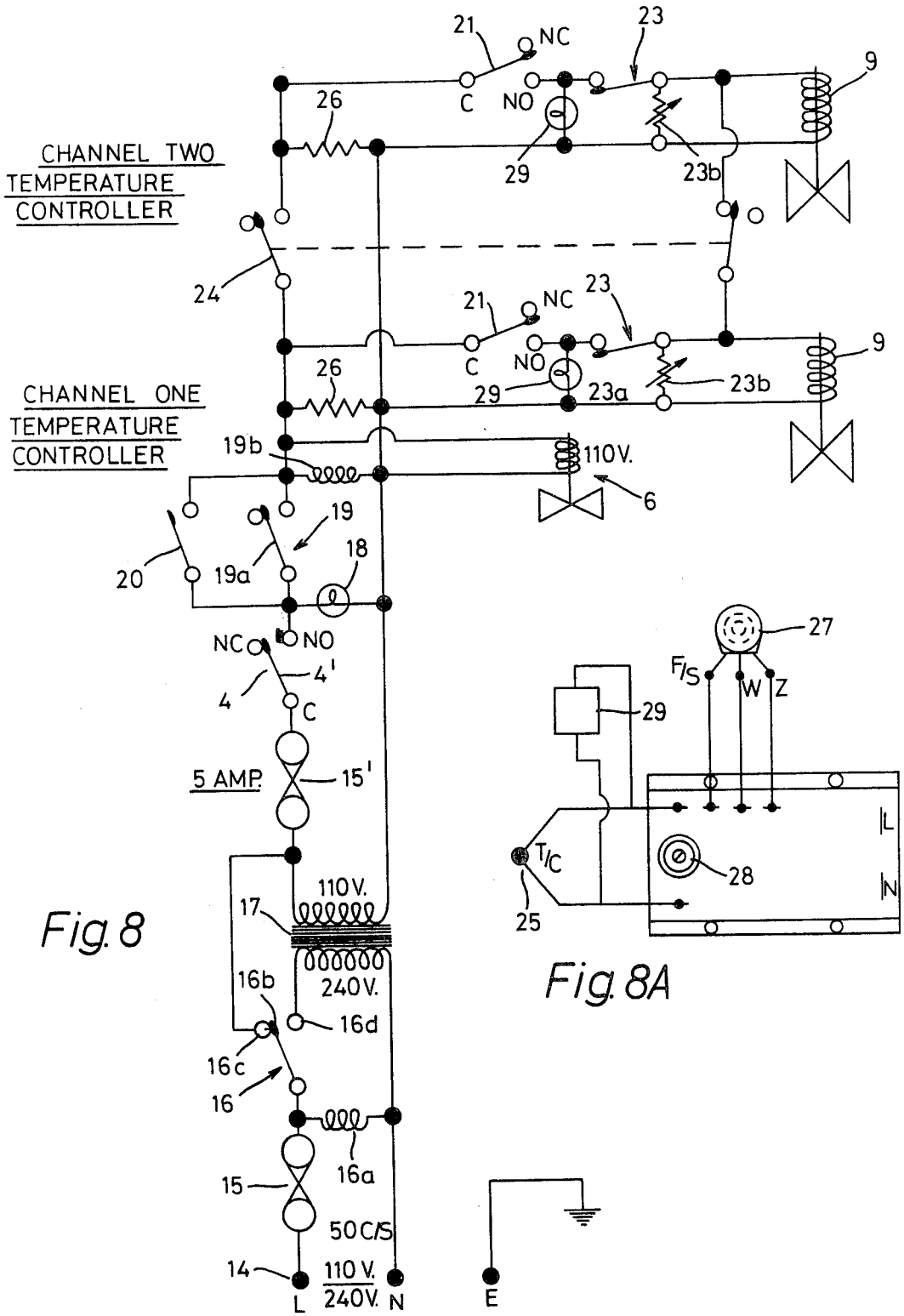

FIG. 8 is a wiring diagram.

The muffle 30 shown in FIGS. 1–3 is fired tangentially by four equidistant tube firing burners (not shown) located in respective immersion tubes 31. Alternatively, it could be fired by two, or six or more equidistant burners (not shown) located in respective immersion tubes depending on the pipe size for which the muffle was designed. The burners 32 are shown in FIGS. 4–8 and may be of the type supplied by The Aeromatic Co. Ltd. of Uxbridge. They simply clamp onto the open ends 33 of the immersion tubes 31. The principle of the tube firing burner is that combustion takes place on an open burner head (nozzle) directed into the open end of a stainless steel or inconel tube called an "immersion tube" where it develops fully. The flame propagates down the tube where both the flame and the products of combustion cause the tube to radiate. The principle is designed for indirect firing of furnaces, kilns and lehrs, etc., where the products are discharged to atmosphere without ever entering the furnace. Tube firing is, in fact, an indirect firing method. However, in this application direct firing is used inasmuch as the flame and products of combustion enter the muffle annulus and are deflected and discharged axially through round or square flue ports 34 as they meet the next tube around the combustion annulus 35.

The muffle includes a stainless steel housing 36 which is split at 37, hinged at 38, and fitted with toggle clamps 39 as shown. It is insulated on both sides and outer face with 25 mm. of 128 kg/m$^3$ density ceramic fibre blanket 40, this being impaled onto K.S.M. 601 Inconel pins 41 strategically positioned around the perimeter of the housing 35. These pins 41 serve two functions, one being to support the insulation 40, the second being to support an annular ring of expanded Inconel sheet 42 positioned 25 mm. above the surface of the pipe 43. This sheet 42 of expanded Inconel acts both as a radiant dissipating heat uniformly onto the pipe surface, and also prevents flame impingement onto the pipe surface by containing the combustion process in a closed annulus 35. It should be noted at this point that the short radiant tubes 31 are not insulated. They radiate freely to both the expanded Inconel and the insulation surfaces.

The numbers of burners 32 chosen will be governed by the temperature uniformity requirement, sufficient numbers being required to maintain a high annular velocity around the pipe 43. Too few burners would produce hot spots. The width of the required hot band governs the width of the burner. Each burner may be tailor-made for a specific pipe size, although it may be possible to make the unit adjustable.

The burners 32 are purely atmospheric, all the air for combustion being entrained from the surrounding atmosphere using the available gas pressure. No additional air supply is required.

The muffle is supplied and controlled from a gas/electric twin heat module temperature controller as described below and as shown in FIGS. 7 and 8. This controller requires only a gas supply and a 5 amp. electrical supply of 110 or 240 volts single phase. The four gas outlets supply the four burners 32 via individual link hoses, each fitted with self-sealing snap couplings 10 as an additional safety feature. The temperature is monitored by directly attached spark discharged contact thermocouples onto the pipe surface. It would be possible to use a motor driven portable generator converted to operate on propane which would make the whole system completely portable for operation in remote regions, the whole system operating from a single tank of propane. The complete set-up would also include a multipoint chart recorder for records of heat treatments.

Referring to FIGS. 4 and 5, each burners 32 comprises a body 50 with a series of inclined circumferentially spaced air holes 51 in a stepped portion 52. A portion 53 of reduced cross-section contains four diametrically located aeration ports 54. A flanged jet holder 55 supports a jet 56 which is connected to a gas supply via a threaded coupling 57. As shown in FIG. 6, the body 50 of the burner 32 is secured in a cone-shaped holder 58 provided with air holes 59. The holder 58 fits over the open end 33 of the respective immersion tube 31. A typical burner rating is 40,000 Btu/hr or 11.7 Kw.

FIG. 7 schematically illustrates a pipe work lay out for the twin heat module temperature controller. Gas enters via a flexible gas supply hose 1, fitted with a self-sealing snap coupling valve 2, at the following pressures:

(a) Propane at 1.4–2.0 a.t.m. (20–30 lbs/ins$^2$)

(b) Natural gas at 0.4–1.0 a.t.m. (5–15 lbs/ins$^2$).

The incoming gas pressure is monitored by a gas pressure operated switch 4 and the gas pressure is indicated on a rear panel mounted pressure gauge 8. Gauge 8 is connected to a pilot branch line by a tubing adaptor 5, the pilot line being connected to a solenoid valve 6 which controls the pilot flow. Pilot flow gas loops, indicated by broken lines, each include a miniature panel mounted pressure regulator 7 to which a front panel mounted pressure gauge 8' is connected. The respective pilot flows are connected to tubing adaptors 13 to pass gas towards respective pairs of self-sealing snap coupling bracket valves 10. Valves 10 are connected to respective burners which are thereby provided with gas at low pressure.

The main gas flow, at a high rate, is divided between a pair of solenoid valves 9 which are connected to the respective coupling/valve 10. The burners are thereby supplied with gas at high pressure. When the valves 9 are closed, they are bypassed by the pilot flow loops indicated by the broken lines. Therefore, the burners attached to the coupling/valves 10 are continuously supplied with gas at either high or low pressure.

The high/low control is effected by the circuit shown in FIG. 8. In this circuit, a socket 14 is connected to a mains supply LNE at either 110 or 240 volts. A fuse 15 is provided for protecting the circuit on 240 volts operation. A relay 16 has a coil 16*a* connected across the L and N mains supply for operating a contact arm 16*b* between contacts 16*c* and 16*d*. When the socket 14 is connected to a 240 volt supply, the coil 16*a* is sufficiently energised to switch arm 16*b* onto contact 16*d*. This brings a transformer 17 into circuit for reducing the voltage to 110 volts. However, when a 110 volt supply is connected to socket 14, the coil 16*a* is not sufficiently energised to move arm 16*b* which, due to spring bias, makes with contact 16*c* to by-pass the transformer 17. A fuse 15' protects the circuit when connected to a 110 volt supply.

The gas pressure switch 4 has a normally closed contact NC and a normally open contact NO. The gas pressure causes the contact arm 4' to move towards the NO contact whereupon an indicator lamp 18 is energised to indicate the presence of gas. At this stage, the circuit beyond the indicator lamp 18 is not energised because a self-holding relay 19, with a contact arm 19*a* and a coil 19*b*, is not yet energized. Coil 19*b* is energized by manually closing a biased reset toggle switch 20. This energises coil 19*b* whereupon contact arm 19*a* makes contact with the rest of the circuit. When coil 19*b* is energized, the pilot solenoid valve 6 is also energized whereby gas, at a low flow rate, is supplied to the pilot loops.

A pair of temperature controllers 26, schematically represented by resistance symbols in FIG. 8, are connected to the supply across coil 19*b*. FIG. 8*a*, which shows one of these controllers in a little more detail, includes a plurality of thermocouples 25, fitted within the muffle 30; a remote temperature controller 27, in the form of a potentiometer; and a trimming control 28, also in the form of a potentiometer. The remote control 27 is used to set the temperature which is to be reached inside the muffle 30 for the heat treatment required. The trimming control 28 is used to provide fine temperature adjustment to avoid adjusting the remote controller 27.

Each temperature controller 26 is provided with a contact breaker 21 for supplying energy to the respective solenoid valve 9. However, a further energy regulator 23 is provided between contact breaker 21 and solenoid valve 9 to control the rate of heating. Each regulator 23 includes a contact arm 23*a* and a variable resistance 23*b*. The energy regulator 23, which is of known construction, is such that adjustment of the variable resistor 23*b* will cause the contact arm 23*a* to open and close on a variable duty cycle. This operation is similar to that of the type of regulator known as a "Simmerstat" which is used to regulate the power supplied to hobs on electrical cookers. Variation in this duty cycle will control the rate at which energy is supplied to the solenoid valve 9 and hence regulates the gas supplied at a high flow rate to the respective burners. In turn, this controls the rate of heating of the muffle 30. When the valves 9 interrupt the main/high gas flow rate, the burner units continue to operate on the pilot/-low gas flow rate set by the miniature adjustable pressure regulators 7.

Relay 19 acts as a safety device to protect against loss of gas pressure and/or electrical supply to the unit. While both gas pressure and the power supply are maintained, relay 19 is self-holding in the energised state and hence supplies the temperature controllers 26 and the pilot flow solenoid valve 6. In the event of a gas and/or power supply failure, relay 20 trips out thereby interrupting the electrical supply to both the temperature controllers 26 and the solenoid valve 6. Switch 20 must be manually closed to restore the gas flow, even after the supplies have been restored. The gas pressure switch is set to trip out at about 0.20 a.t.m. (3 lbs/ins$^2$).

A double pole, double throw toggle switch 24 is provided as a single channel/individual channel selector switch which enables (a) both the solenoid valves 9 to be operated from a single temperature controller 26, namely, the one connected nearest to relay 20, or (b) the valves 9 to be independently controlled by the respective temperature controllers 26 shown in FIG. 8.

The valves used in the control console are provided between self-sealing snap couplings 2, 10, which couplings will only operate when the connection is complete and which require a twist-pull-twist action to open. These couplings provide a positive shut-off and even discharge the line pressure automatically as they are closed.

The thermocouples 25 (FIG. 8*a*) may be connected to a multipoint, chart recorder 29 to record the heating of the muffle.

In an alternative arrangement, a two-point digital read-out solid state programmer is used instead of the two temperature controllers 26 and the two energy regulators 23. Each point of the programmer may have three outlets such that a 30 inch diameter pipe may be heat treated by means of six burners positioned in a suitable muffle. The muffle may have a housing 36 constructed in three segments each extending over an arc of 120°, instead of the two sections described in the embodiment of FIGS. 1–3.

The following procedure may be used to start the system described with reference to FIGS. 7 and 8.

1. Position the control console to suit the operation.
2. Connect the gas link hoses between the burners and the console using hoses fitted with self-sealing snap couplings 10.
3. Position and control thermocouple/thermocouples 25 and connect to the console with compensating cables.
4. Start with all the manual valves closed, temperature controllers 26 set a 0° C, energy regulators 23 set in the "off" position and pilot regulators 7 set at zero output pressure.
5. Connect up the appropriate gas supply to the unit using the snap coupling 2.
6. Turn on the gas supply to the unit using the valve incorporated in the self-sealing coupling 2.
7. Connect a 110/240 V. 50 cycle 5 amp power supply to socket 14.

8. Switch on the power supply. A red light (18) is then illuminated on the console front panel showing the presence of gas pressure.

9. Operate the biased re-set toggle switch 20 on the front of the console. This energises the electrical relay 19 and opens the pilot/low flow gas solenoid valve 6.

10. Open the first individual valve 10 (channel one) to first burner. No gas flow should be heard. If it can, close valve and return to stage 4. Proceed as before.

11. Dial in a pilot/low gas flow rate on the channel one pilot regulator 7, i.e., 0.20–0.40 a.t.m. (3–6 lbs/ins$^2$). Check pressure on appropriate gauge 8'.

12. Light first burner and adjust.

13. Open second individual valve 10 (channel one); gas should be heard to flow.

14. Light second burner and adjust as required. It may be necessary to raise the pilot/low gas flow rate slightly to accommodate the second burner demand.

15. Proceed with channel two in a similar manner from stage 10.

16. Finally, set a target temperature on the channel one temperature controller 26. An orange panel light 29 is then illuminated on the front of the console displaying "call for heat."

17. Set the channel one energy regulator to 100% (for an uncontrolled rate of climb to target temperature). The channels are now on fire. When the main/high gas solenoid 9 de-energizes (closes) the burner continue to operate on the pilot/low gas flow rate.

18. Proceed with channel two in a similar manner from stage

16.

The following procedure enables a shut-down in an emergency:

1. Turn off and disconnect the gas supply to the unit.

2. Disconnect the electrical supply to the unit, or both.

If either the gas pressure and/or electrical supply fails, the relay 19 will de-energize. The gas flow can only be reestablished after the failure has been rectified by physically re-setting the biased toggle switch 20.

The chief advantages of this design of muffle described above are as follows:

1. The lightweight stainless steel housing permits rapid set-up and removal from pipework.

2. The low thermal mass insulation used permits rapid heat-up of the muffle.

3. Simple open-flame type tube firing burners have been used.

4. The burners are easily fitted with thermo-magnetic flame failure valves.

5. No pilots are required, i.e., High/low main flame control is achieved using the twin heat module temperature controller.

6. High gas operating pressures provide relatively high re-circulation velocities inside the muffle.

7. The expanded Inconel layer provides good temperature uniformity by acting as a radiant member and preventing flame impingement on the workpiece.

8. Temperature measure is made possible by the use of directly attached spark discharged thermocouples onto the surface of the pipe which measures actual skin temperatures with minimal radiation effects.

The scope of the invention is defined by the following claims:

1. A tangentially gas fired muffle comprising an annular housing, said housing defining first and second annular chambers divided by a ring of perforate or expanded heat resistant material, said first annular chamber being provided with circumferentially spaced inlet and outlet ports, said inlet ports being in the form of immersion tubes directed tangentially into said first chamber, an atmospheric gas burner being located in each of said immersion tubes for directing its products of combustion into said first chamber, and said outlet ports being located adjacent said immersion tubes for discharging the products of combustion of the gas burners in previous tubes, whereby said ring contains the combustion processes within said first chamber and acts as a radiant for dissipating heat uniformly onto the surfaces of pipe sections bounded, in use, by said second annular chamber.

2. A muffle according to claim 1 wherein said housing is split, hinged and fitted with means for securing the split parts together whereby said housing may be hinged open to accommodate welded pipe sections and said part subsequently closed together and fastened by said securing means.

3. A muffle according to claim 2 wherein said first annular chamber is lined with insulation.

4. A muffle according to claim 2 wherein said insulation is in the form of a ceramic fibre blanket, said blanket being impaled on heat resistant pins which are circumferentially spaced about said first annular chamber and which support said perforate or expanded metal ring.

5. A muffle according to claim 3 wherein said ring is made of expanded inconel.

6. A muffle according to claim 1 including first solenoid valve means for supplying gas at a high flow rate to said burners, second solenoid valve means for supplying gas at a low flow rate to said burners when said first solenoid valve means are closed, and temperature controlling means connected to said first solenoid valve means whereby said burners are continuously supplied with gas at respective high and low flow rates when said first solenoid valve means is respectively energized and de-energized by said temperature controlling means.

7. A muffle according to claim 6 including energy regulating means for controlling the rate of heating of said muffle, said energy regulating means being connected to said temperature controlling means and to said first solenoid valve means.

8. A muffle according to claim 7 including self-holding relay means for isolating the electrical circuit in the event of a power failure, said temperature controlling means and said second solenoid valve means being connected to said self-holding relay means.

9. A muffle according to claim 8 wherein said self-holding relay means is connected to gas pressure responsive switching means whereby said burners are isolated from the gas supply in the event of a reduction in gas pressure below a predetermined value.

10. A muffle according to claim 1 including an electrically controlled gas supply circuit and a twin heat module temperature controller, said gas supply circuit comprising gas inlet means, gas outlet means and main solenoid valve means, said main solenoid valve means being connected between said gas inlet means the respective gas burners; pilot solenoid valve means and pilot gas pressure regulating means, said pilot solenoid valve means and said pilot gas pressure regulating means being connected between said gas inlet means and the respective burners; and gas pressure electrical switch means connected to said gas inlet means;

said twin heat module temperature controller comprising temperature sensing means and energy regulating means responsive to a predetermined temperature, said temperature sensing means being operative to provide a signal representing the respective temperature of said pipe sections, said energy regulating means having contacts connected to said main solenoid valve means whereby the rate of heating of said muffle is controlled at twin heat settings determined by energization and de-energization of said main solenoid valve means by said contacts.

11. A muffle according to claim 10 wherein said twin heat module temperature controller includes self-holding relay means for isolating both the electrical and gas supply, said self-holding relay means being connected to power input terminals whereby the electrical circuit is isolated in the event of a power supply failure, and said self-holding relay means being connected to said gas pressure electrical switch means whereby said burners are isolated from the gas supply in the event of a reduction in gas pressure below a predetermined value.

* * * * *